US011439212B2

(12) United States Patent
Takessian

(10) Patent No.: US 11,439,212 B2
(45) Date of Patent: Sep. 13, 2022

(54) EASY ATTACH BACK FOR PIERCED EAR TYPE EARRINGS

(71) Applicant: Garabed Takessian, Canton, MI (US)

(72) Inventor: Garabed Takessian, Canton, MI (US)

( * ) Notice: Subject to any disclaimer, the term of this patent is extended or adjusted under 35 U.S.C. 154(b) by 0 days.

(21) Appl. No.: 17/087,039

(22) Filed: Nov. 2, 2020

(65) Prior Publication Data

US 2021/0127801 A1 May 6, 2021

Related U.S. Application Data

(60) Provisional application No. 62/928,768, filed on Oct. 31, 2019.

(51) Int. Cl.
*A44C 7/00* (2006.01)

(52) U.S. Cl.
CPC ..... *A44C 7/003* (2013.01)

(58) Field of Classification Search
CPC ..... Y10T 24/41; A44C 7/003
USPC ..... 24/705; D11/88
See application file for complete search history.

(56) References Cited

U.S. PATENT DOCUMENTS 396,788 A * 1/1889 Washburn ..... A44C 7/003 24/705
4,580,417 A * 4/1986 Sardelli ..... A44C 7/003 24/705

FOREIGN PATENT DOCUMENTS

KR 20100005103 U * 5/2010

* cited by examiner

*Primary Examiner* — Jack W Lavinder
(74) *Attorney, Agent, or Firm* — Carrier Blackman & Associates, P.C.; Joseph P. Carrier; William D. Blackman

(57) ABSTRACT

An earring back for a pierced ear earring includes a first receiver having a first recessed, concave surface which has a first opening defined through a center, most recessed position thereof, which opening is configured to securely receive a post of a pierced-ear earring therein, and a second receiver with a second recessed, concave surface having a second opening defined through a center, most recessed position thereof which is configured to securely receive the post of the pierced-ear earring therein after the post extends through the opening of the first receiver. The second receiver is fixed in spaced relation to the first receiver such that the first and second openings are coaxially aligned.

6 Claims, 6 Drawing Sheets

EASY ATTACH BACK FOR PIERCED EAR TYPE EARRINGS

CROSS-REFERENCE TO RELATED APPLICATIONS

The present application claims the benefit of priority to U.S. Provisional Patent Application No. 62/928,768, filed Oct. 31, 2019. The entire subject matter of this priority document, including specification claims and drawings thereof, is incorporated by reference herein.

BACKGROUND OF THE INVENTION

1. Field of the Invention

The present disclosure relates to novel earring clutches, backs or backers (hereinafter "backs") used to secure pierced ear type earrings to a person's ear or other body part with improved ease. More particularly, the present invention relates to such earring backs which are structured to help guide earring posts into receiving holes of the earring backs, so that a person may easily attach an earring to the person's ear or other body part without looking at the earring components being attached together.

2. Background

Earrings and similar jewelry (hereinafter referred to as "earrings" regardless of where the item is worn on the body) may be classed into different types dished on how they are attached to the ear or other part of the body. One class of pierced ear type earrings, referred to as "stud earrings" or "post earring", comprise a decorative ornament which is adapted to be worn on the front side of a pierced ear lobe, an elongated post or stem which has a distal end extending rearwardly from the ornament and being positionable so that it extends through an aperture or opening defined in a person's ear lobe, and then has an earring back with a receiving hole defined therethrough secured to the post, e.g., by sliding or pushing the back onto the post at the rear side of the ear lobe to prevent the post from being accidentally withdrawn from the aperture in the ear lobe. While a variety of types of backs have heretofore been available for use in combination with post earrings, it may be unduly difficult or challenging for some users to attach an earring back to an earring post which has been extended through the user's ear or other body part because the user typically cannot observe the back while the earring post is being inserted into the receiving opening of the back and must primarily rely on sense of touch for properly fitting the post into the opening of the back.

One particular type of back commonly known as a push-on back engages with the post, often in a friction fit, to hold the earring in place. Another type of back that can provide more holding force is a locking or screw-on back, which has a receiving hole that is configured to securely receive a post having grooves which are formed on the outer surface of the post. The grooves of the post may be pushed or screwed into receiving hole of the back, thus ensuring a secure fit. This is one type of snap fit engagement that provides a strong gripping force to retain the back on the post.

When the earring is to be attached to a person's ear, the back is typically positioned behind the ear by one of the user's hands while the main part of the earring including the post may be positioned by the user's same hand or other hand, which makes it difficult or impossible to see even in a mirror, particularly when the fingers extend into this small space and further obstruct the view of the back. The distal end of the post and the receiving opening in the back of the post are generally quite small, which also contributes to some difficulty in attaching the back to the post.

Another issue that makes earring attaching difficult is that the back usually has a flat or substantial flat face surrounding the receiving hole and which engages against the back of the ear lobe when the back/is attached to the post. Referring to FIG. 1, there is shown in a conventional post earring 1 which includes a decorative ornament 2, post 3 and a back 5. The back 5 has a flat face 18 which surrounds a receiving hole 17 defined therethrough, which makes it difficult to locate the receiving hole 17 with a free end 4 of the post such that the post may shift sideways from the receiving hole 17 as the user attempts to insert the post into the receiving hole 17.

These and other difficulties can make attaching an earring cumbersome, slow, and result in soreness of the earlobe, particularly for wearers of starter post earrings whose earlobes are already tender from the initial piercing. Also, if the earring back is not properly secured to the post, it is possible for the back to become unintentionally attached to the post, which could then result in the earring becoming unintentionally detached from the user's ear and possibly lost. Therefore, in light of these challenges, it is a desideratum in the art to have an earring back which can be easily and securely attached to an earring post.

SUMMARY OF THE INVENTION

It is an object of the present invention to satisfy the discussed desideratum, and to overcome the drawbacks of the known earring backs.

According to a first aspect of the present invention, an earring back for a pierced ear earring comprises: a first receiver having a first recessed, concave surface which is configured to face towards a user's body part concave conical surface has a first opening defined through a center thereof which is configured to securely receive a post of a pierced-ear earring therein, the first opening being positioned at a most recessed position of the first recessed, concave surface; and a second receiver with a second recessed, concave surface having a second opening defined through a center thereof which is also configured to securely receive the post of the pierced-ear earring therein, the second receiver being fixed in spaced relation to the first receiver such that the first and second openings are coaxially aligned and such that the second receiver is disposed farther away from the user's body part than the is the first receiver when the earring back is engaged against the user's body part.

With the back according to the first aspect of the invention, when the user is fitting the earring post to the back, the recessed, substantially conical surfaces of the first and second receivers conveniently guide a free end of the earring post into the first and second openings, respectively, thereby facilitating the fitting process and such that the fitting process may be easily performed just by sense of touch.

Also, with the back including the first and second receivers, the earring post maybe more securely fixed to the earring back because different portions of the post are respectively secured within the first and second openings of first and second receivers, but the process of fitting the post to the back is still relatively easy to perform because the free end of the post is conveniently guided into the first and second openings by the first and second recessed, substantially conical surfaces, respectively.

According to a second aspect of the present invention, an earring back for a pierced ear earring comprises: a first receiver having a recessed, concave surface which is configured to face towards a user's body part when the back is engaged against the body part, wherein the recessed, concave surface has an opening defined through a center thereof which is configured to securely receive a post of a stud earring therein, the opening being positioned at a most recessed position of the recessed, concave surface; and a second receiver including plurality of flexible projections connected to and projecting away from a side of the first receiver opposite to the recessed, concave surface, wherein the flexible projections are spaced apart from each other by a gap, wherein the gap is configured to securely receive the post of the stud earring therein, and wherein the gap is spaced from and aligned with the opening in the recessed, concave surface of the first receiver.

With the earring back including the first receiver including the recessed, concave surface and center opening and the second receiver including the plurality of flexible projections, when the user is fitting the earring post to the back, the recessed, substantially conical surface of the first receivers and the gap between the flexible projections of the second receiver conveniently guide a free end of the earring post into the opening and the gap, respectively, thereby facilitating the fitting process and such that the fitting process may be easily performed just by sense of touch.

Also, the earring post maybe more securely fixed to the earring back because different portions of the post are respectively secured by the opening in the first receiver and the gap between the end portions of the flexible projections of the second receiver, but the process of fitting the post to the back is still relatively easy to perform because the free end of the post is conveniently guided into the first opening by the first recessed, substantially conical surface and easily slides into the gap between the end portions of the flexible projections.

Intent of Disclosure

Although the following disclosure of present exemplary embodiments of the invention is offered for public dissemination is detailed to ensure adequacy and aid in understanding of the invention, this is not intended to prejudice that purpose of a patent which is to cover each new inventive concept therein no matter how it may later be disguised by variations in form or additions of further improvements. The claims at the end hereof are the chief aid toward this purpose, as it is these that meet the requirement of pointing out the improvements, combinations and methods in which the inventive concepts are found. The invention accordingly comprises the features of construction, combination of elements and arrangement of parts that will be exemplified in the following detailed disclosure, and the scope of the invention will be indicated in the claims. Other features and advantages of the invention will be apparent from the description, the drawings and the claims.

BRIEF DESCRIPTION OF THE DRAWINGS

For a fuller understanding of the invention, reference is made to the following description taken in conjunction with the accompanying drawings, in which.

DETAILED DESCRIPTION OF THE EXEMPLARY EMBODIMENTS

Exemplary embodiments of the invention will be described below.

Figure 1:
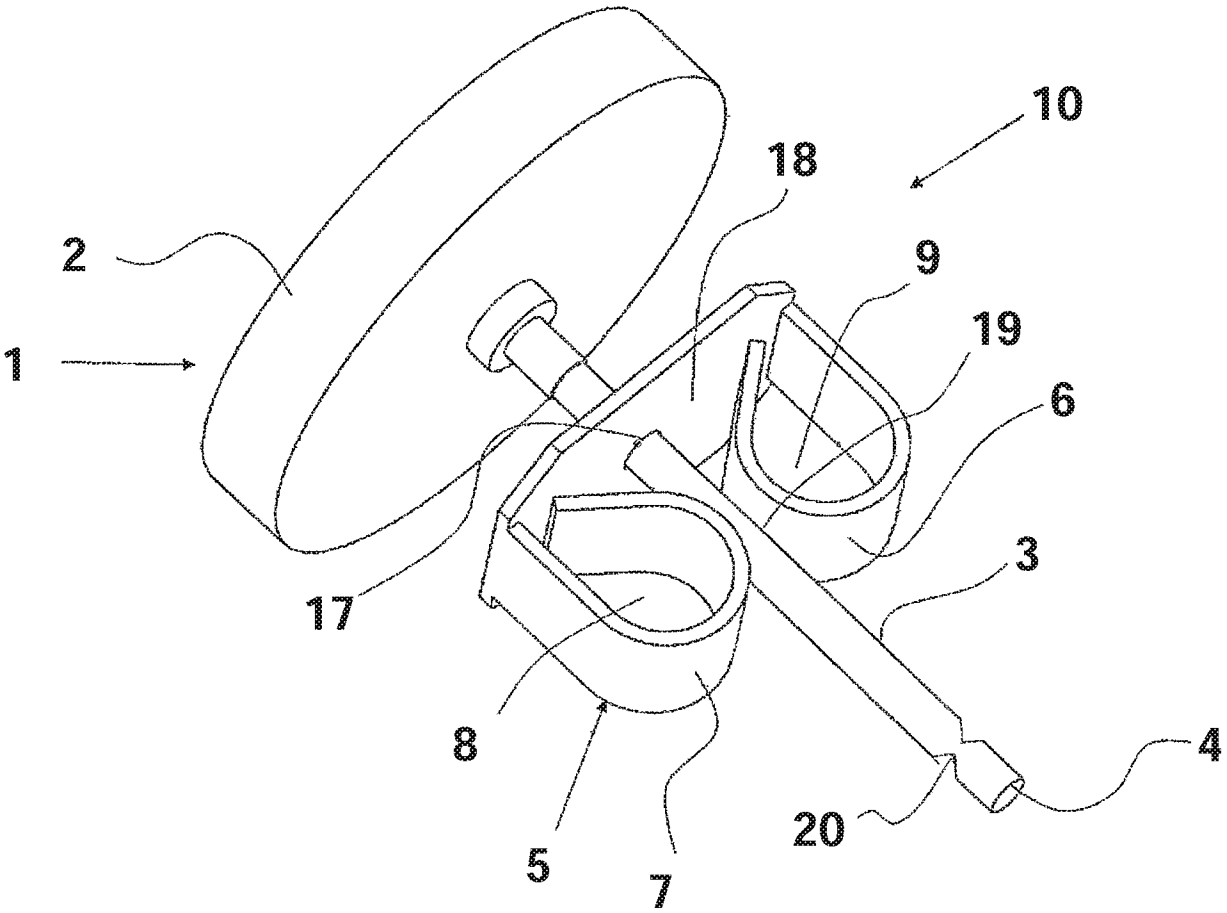
FIG. 1 Prior Art
FIG. 1 is a perspective view of a conventional post earring.
Figure 2:
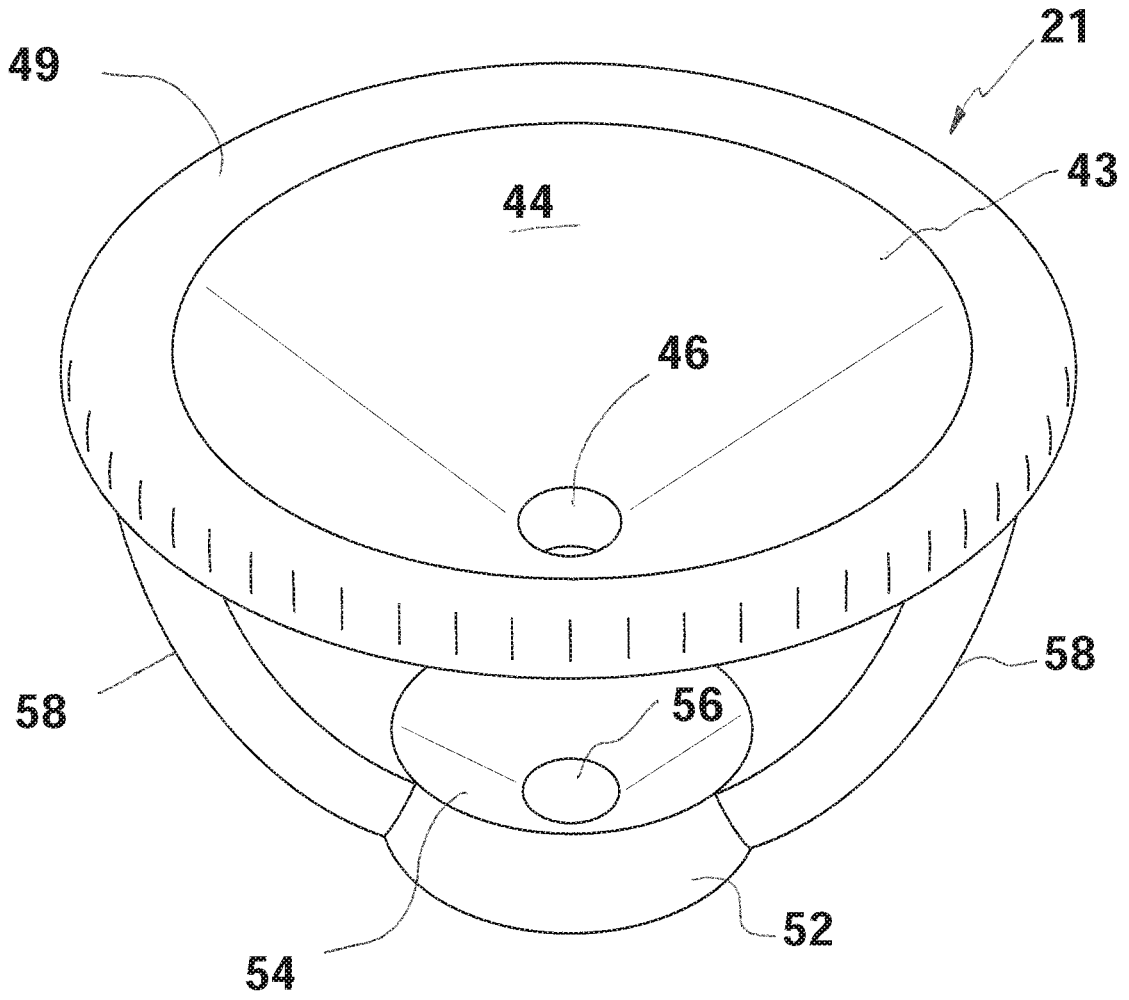
FIG. 2 is an perspective view of an earring back according to a first exemplary embodiment of present invention.
Figure 3:
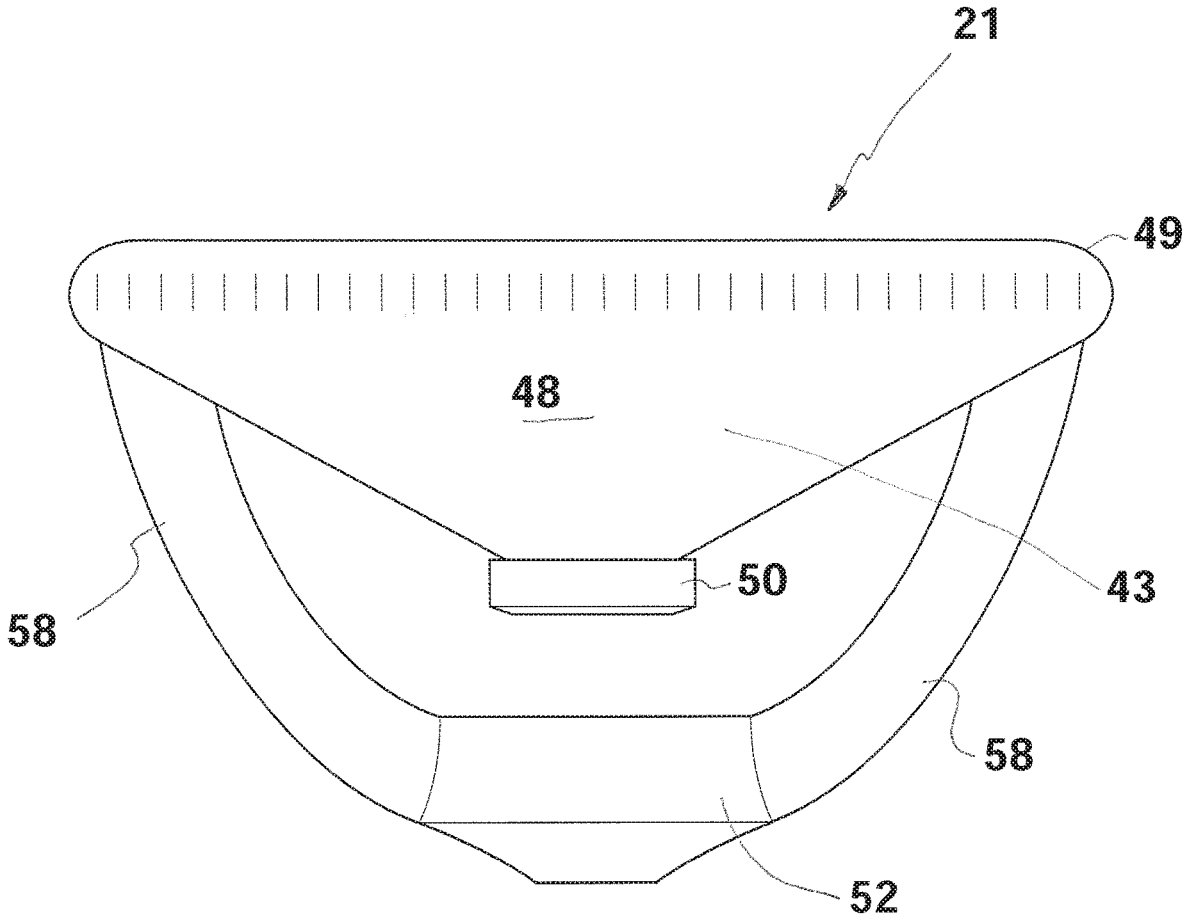
FIG. 3 is a side view of the back in FIG. 2.
Figure 4:
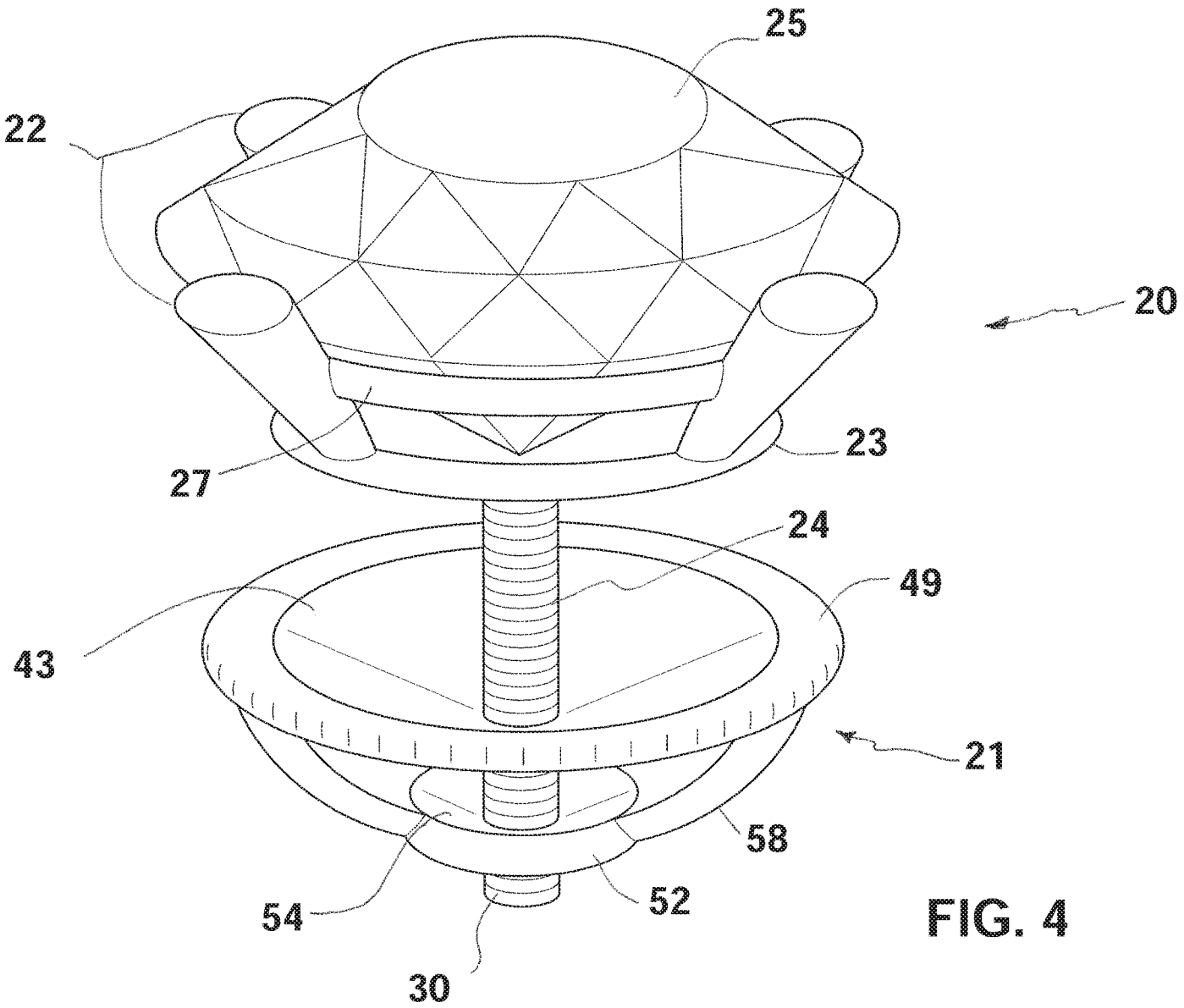
FIG. 4 is a perspective view showing a stud type earring having the earring back of FIG. 2 attached thereto.

FIGS. 2-4 illustrate a first exemplary embodiment of present invention directed to a stud type earring 20. As shown, earring 20 generally includes a back 21, a base plate 23, a plurality of prongs 22 that are spaced from each other and project from one face of the base plate and are used to secure a decorative item 25, such as a gemstone, a circular member 27 which connects intermediate portions of the prongs 22 and which also helps to secure the decorative item 25, and an elongate post 24 which projects from an opposite face of the base plate at a central portion thereof, and which is configured to be securely received in openings 46, 56 defined in the back 21. The prongs 22 and the circular member 27 may be dimensioned and shaped so as to grip decorative item 25 and secure the decorative item 25 to the base plate 23. The particular structure of the earring 20 apart from the back 21 and that the earring includes the post 24 for being secured to the back is not important to the present invention. Hence, other portions of the earring may have essentially any desired structure and appearance, e.g., the decorative item 25 may be other than a gemstone and may be integrally formed with prongs 22, etc. As depicted, the post 24 has a distal end 30 which extends furthest away from the base plate 23 and which will extend through the openings 46, 56 in the back, while some portion of the post 24, including the distal end 30, may have grooves defined in an outer surface thereof which help maintain the back secured to the post.

The back 21 may include a first larger receiver 43 and a second smaller receiver 52 each of which are concave or conical in shape and which respectively include the central openings 46, 56 defined therein. The first and second receivers 43, 52 may be fixed in together in any appropriate manner such that the first and second openings 46, 56 are coaxially aligned with a space therebetween and such that the second receiver 52 is disposed farther away from the user's ear lobe than the is the first receiver 43 when the back 21 is engaged against the user's ear lobe.

As depicted, the first receiver 43 may have a smooth concave or substantially conical surface 44 on one side thereof and a convex or substantially convex surface 48 on an opposite side thereof which extends toward the second receiver 52. The opening 46 is defined through a center of the first receiver 43 and the opening 56 is defined through a center of the second receiver 52, while both holes have the same diameter which is appropriate to securely receive a post of a standard earring therein such as the post 24. For example, the openings 46, 56 may have a diameter which is slightly larger than the outer diameter of the post 24, while the surfaces defining the openings may be smooth or threaded, e.g., a threaded opening may include threads configured to securely receive the threads provided on the outer surface of the post 24. The first opening 46 may be positioned at a most recessed position of the first recessed, substantially conical surface 44, and the first recessed, substantially conical surface 44 may have a circular circumference. These features are particularly useful for easily guiding the end 30 of the post 24 into the first opening 46. The shape of the opposite side surface 48 is not especially important and may be other than convex.

As shown, the first receiver 43 may be substantially conical in shape, with a substantial "V" shape or a funnel shape appearance in side view, a rounded or curved lip 49 which will engage against the user's ear lobe, and a short tubular extension 50 which axially extends from the surface 48 and has a portion of the central opening 56 defined therethrough. Again, an inside surface the portion of the opening 46 in tubular extension 50 may be smooth or threaded.

The second receiver 52 may have a second recessed, substantially conical surface 54 having a second opening 56 defined through a center thereof which is also configured to securely receive any standard earring post such as the post 24 of the stud earring 20 therein similar to the first opening 46. The second receiver 52 may be fixed to the first receiver 43 in any appropriate manner such that the first and second openings 46, 56 are coaxially aligned in spaced relation and such that the second receiver 52 is disposed farther away from the user's ear lobe than is the first receiver 43 when the back 21 is secured to a earring post and engaged against the user's ear lobe. The second receiver may have a size which is different from the size of the first receiver, but could be the same size. In the depicted embodiment the second receiver 52 is smaller than the first receiver 43, and a pair of opposed connecting walls or shanks 58 are provided to connect the first and second receivers together in a fixed relationship.

When the wearer desires to attach the back 21 to the earring post 24, e.g., when the user is attaching an earring to the user's ear, the earring back is moved toward the distal end 30 of the post 24 so that the distal end 30 engages the first recessed, substantially conical surface 44 of the first receiver 43 and is conveniently guided towards and into the first opening 46 at the most recessed part of the first receiver 43 based on the smooth, concave, substantially conical shape of the surface 44 and the position of the first opening 46 at the central, most recessed part of the surface 44. After the distal end 30 passes through the first opening 46 and moves towards the second receiver 52, the second recessed, substantially conical surface 54 of second receiver similarly guides the distal end 30 towards and into the second opening 56 of the second receiver 52 based on the smooth, concave, substantially conical shape of the surface 54 and the position of the second opening 56 at the central, most recessed part of the surface 54. Of course, once the distal end 30 of the post has been extended through the first opening 46 it's movements will be restricted to some extent by the engagement between the first opening 46 and the post, but the concave shape of the second receiver 52 will still help to guide the distal end 30 of the post into the opening 56. Thus, the user may easily slide the distal end 30 of the post sequentially into the openings 46, 56 of the back 21. In this way, the back 21 securely engages the post 24 to hold the earring 20 in the user's ear lobe.

Again, some portion of the post 24, such as the distal end 30, may have grooves formed in the outer surface thereof as depicted which may be screwed or pushed into mating threads formed in surfaces of the first and/or second openings 46, 56 to better secure the post and the back together if so desired. Also, the curved lip 49 of the first receiver 43 may have ridges formed on the outer surface thereof which may help a user to better grip and manipulate the earring back 21.

Figure 5:
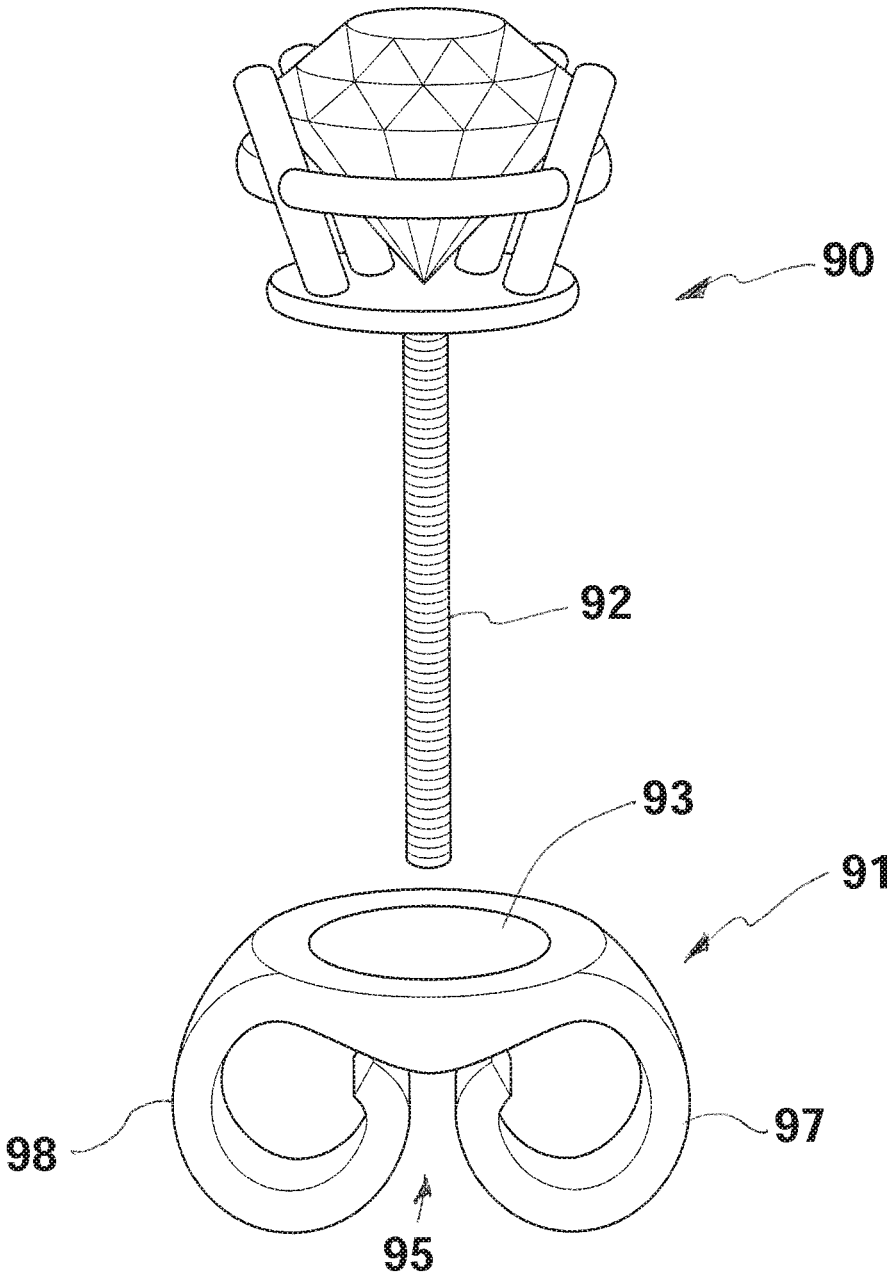
FIG. 5 is an exploded perspective view of a stud earring and an earring back according to a second exemplary embodiment of present invention.
Figure 6:
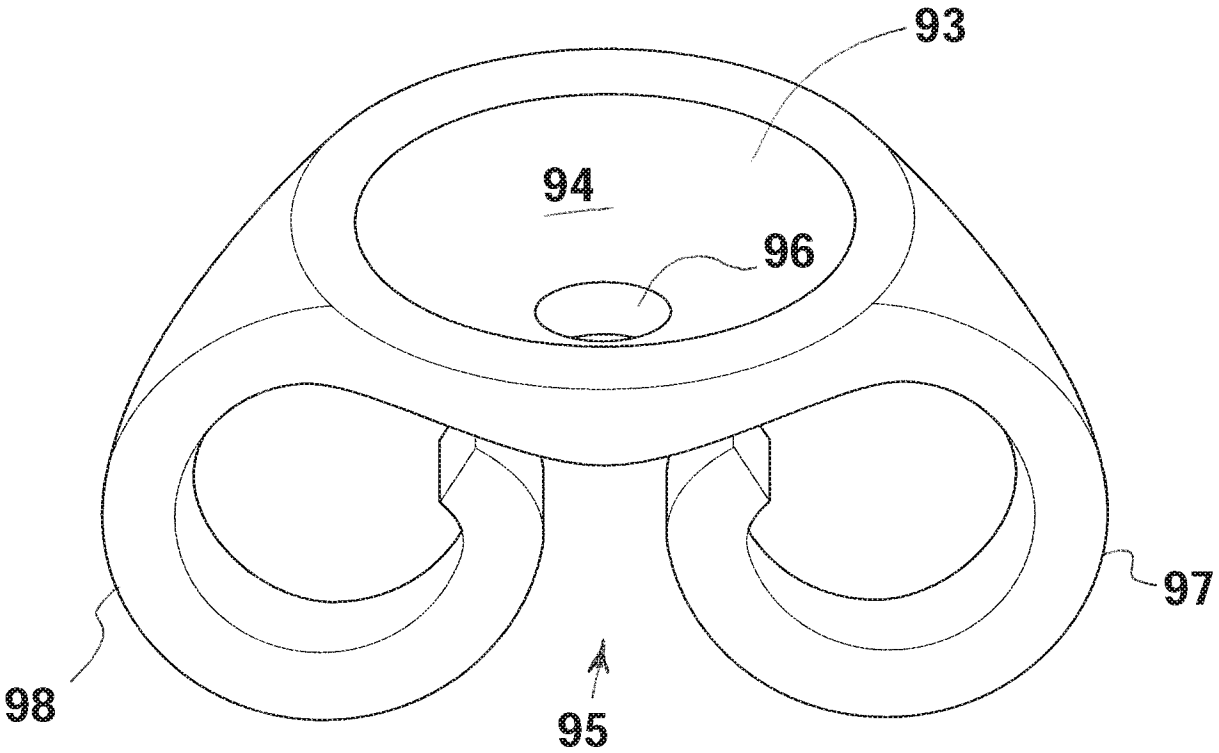
FIG. 6 is an enlarged perspective view of the earring back in FIG. 5.

FIGS. 5-6 show a stud type earring 90 including a post 92 and a second exemplary embodiment of an earring back 91 according to the present invention. Besides the earring back 91, the remainder of the earring 90 is essentially the same as the earring 20 of the first embodiment and is not discussed here. The back 91 generally includes a first receiver 93 which is similar to the first receiver 43 in the first embodiment, together with a second receiver which includes an opposing pair of flexible projections 97, 98 extending away from a side of the first receiver 93 and having rounded end portions which are spaced from the receiver 93 and define a gap 95 therebetween.

The first receiver 93 may have a smooth, recessed or concave, substantially conical surface 94 on one side thereof, a convex, substantially conical surface on an opposite side thereof and an opening 96 defined through a center thereof which is configured to securely receive the post 92 of the stud earring therein. For example, the opening 96 may have a diameter which is just slightly smaller than the outer diameter of the post 94, the surface defining the opening 96 may be threaded to better receive the threads formed on the outer surface of the post 92, etc. As shown, the opening 96 may be positioned at a most recessed position of the recessed, substantially conical surface 94, and the recessed, substantially conical surface 94 may have a circular circumference. These features are particularly useful for easily guiding the end 30 of the post 24 into the opening 96. The shape of the opposite side surface of the receiver 93 is not especially important but should not interfere with the flexible projections 97, 98. The first receiver 93 may also include a tubular extension which projects from the opposite side surface thereof similar to the extension 50 in the first exemplary embodiment, although no such extension is depicted in FIGS. 5-6.

The flexible projections 97, 98 of the second receiver may project away from a side of the first receiver 93 opposite to the concave, substantially conical surface 94 and the end portions of the flexible projections 97, 98 may curve inwardly towards each other to define the gap 95 therebetween, which is spaced from and aligned with the opening 96 of the first receiver. Use of such stud-gripping projections in earring backs is commonly referred to as a "butterfly" arrangement. A width of the gap 95 is substantially the same as a diameter of the post 92 so that when the post is inserted through the gap opposing surfaces of the end portions of the flexible projections will securely grip the post. The width of the gap 95 may be slightly smaller than the diameter of the post 94 such that when the post is inserted into the gap the end portion of the projections 97, 98 elastically flex away from each other to better grip the post with a small spring force. While two projections 97, 98 are used in this embodiment, the second receiver may include a different number of projections such as three or four.

When the wearer desires to attach the earring back 91 to the post 92, the earring back is moved toward the distal end 30 of the post 92 so that the distal end of the post engages the first recessed, substantially conical surface 94 of the first receiver 91 and is conveniently guided towards and into the opening 96 at the most recessed part of the first receiver 43 based on the smooth, concave, substantially conical shape of the surface 94 and the position of the opening 96 at the central, most recessed part of the surface 94. After the distal end of the post passes through the opening 96 and moves towards the gap 95 of the second receiver, the rounded end portions of the projections 97, 98 guide the distal end 30 toward and into the gap 95 based on the smooth, rounded shape of the end portions and the aligned position of the gap relative to the opening 96. Thus, the user may easily slide the distal end of the post 92 sequentially into the opening 96 and the gap 95 of the earring back 91. In this way, the back 91 securely engages the post 92 to hold the earring 20 in the user's ear lobe. Again, some portion of the post 92, such as the distal end, may have grooves formed in the outer surface thereof which my be screwed or pushed into mating threads formed in a surface of the opening 96 and/or into the gap 95 to better secure the post and the back together, if so desired.

A number of embodiments of the present invention have been described. Nevertheless, it will be understood that various modifications may be made without departing from the spirit and scope of the invention. Accordingly, other embodiments are within the scope of the following claims. Because certain changes may be made in the construction set forth above without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. An earring back for a pierced ear earring comprising:

a first receiver having an outer peripheral lip and a first recessed, concave surface extending continuously from the outer peripheral lip and which is configured to face towards a user's body part, the first recessed concave conical surface has a first opening defined through a center thereof which is configured to securely receive a post of a pierced-ear earring therein, the first opening being positioned at a most recessed position of the first recessed, concave surface; and a second receiver with a second recessed, concave surface having a second opening defined through a center thereof which is also configured to securely receive the post of the pierced-ear earring therein, the second receiver being fixed in spaced relation to the first receiver such that the first and second openings are coaxially aligned and such that the second receiver is disposed farther away from the user's body part than the is the first receiver when the earring back is engaged against the user's body part.

2. The earring back according to claim 1, wherein the second receiver is smaller than the first receiver.

3. The earring back according to claim 1, wherein the first and second recessed, concave surfaces are smooth.

4. The earring back according to claim 1, wherein each of the first and second recessed, concave surfaces has a circular circumference.

5. The earring back according to claim 1, wherein the first receiver has a circumferential edge with a grip-enhancing surface.

6. The earring back according to claim 1, wherein the first receiver includes a tubular extension which extends distally and axially with the first opening and projects toward the second receiver.

* * * * *